US009914302B2

(12) United States Patent
Ozawa

(10) Patent No.: US 9,914,302 B2
(45) Date of Patent: Mar. 13, 2018

(54) LIQUID EJECTING HEAD AND LIQUID EJECTING APPARATUS

(71) Applicant: SEIKO EPSON CORPORATION, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/223,393

(22) Filed: Jul. 29, 2016

(65) Prior Publication Data

US 2017/0057227 A1 Mar. 2, 2017

(30) Foreign Application Priority Data

Sep. 1, 2015 (JP) ..... 2015-171736

(51) Int. Cl.
*B41J 2/16* (2006.01)
*B41J 2/14* (2006.01)

(52) U.S. Cl.
CPC ..... *B41J 2/1433* (2013.01); *B41J 2/14233* (2013.01); *B41J 2/1606* (2013.01)

(58) Field of Classification Search
CPC .. B41J 2/14016; B41J 2/14201; B41J 2/1433; B41J 2/1606; B41J 2/1609; B41J 2/162; B41J 2/1623; B41J 2002/16502
See application file for complete search history.

(56) References Cited

U.S. PATENT DOCUMENTS 5,365,255 A 11/1994 Inoue et al.
5,594,479 A 1/1997 Inoue et al.
5,796,415 A 8/1998 Inoue et al.
5,798,778 A 8/1998 Kimura et al.
7,357,482 B2 * 4/2008 Sugahara ..... B41J 2/1606 347/29
7,651,211 B2 * 1/2010 Mori ..... B41M 5/00 347/101
7,762,650 B2 * 7/2010 Miura ..... B41J 2/1433 347/45
7,837,300 B2 * 11/2010 Mori ..... B41J 2/1433 347/45
8,047,630 B2 * 11/2011 Kakuda ..... B41J 2/14274 347/45
8,752,936 B2 * 6/2014 Nakamoto ..... B41J 2/14233 347/45
9,205,652 B2 * 12/2015 Sameshima ..... B41J 2/1433

FOREIGN PATENT DOCUMENTS

JP 57-157765 A 9/1982
JP 22763410 A 3/1998
JP 11-268148 A 10/1999
JP 3332503 A 7/2002
JP 2005-7789 A 1/2005
JP 2007-331127 A 12/2007
JP 4838056 A 10/2011

* cited by examiner

*Primary Examiner* — Anh T. N. Vo
(74) *Attorney, Agent, or Firm* — Workman Nydegger

(57) ABSTRACT

A liquid ejecting head includes a nozzle face on which nozzles which eject liquid onto a medium are formed; a first region with a liquid repelling property which is connected to a peripheral edge of the nozzle when planarly viewed; and a second region with a liquid repelling property lower than that in the first region, which is connected to a peripheral edge of the nozzle when planarly viewed.

17 Claims, 8 Drawing Sheets

LIQUID EJECTING HEAD AND LIQUID EJECTING APPARATUS

BACKGROUND

1. Technical Field

The present invention relates to a technology of ejecting liquid such as ink.

2. Related Art

In a liquid ejecting head which ejects liquid such as ink from a plurality of nozzles which are formed on a nozzle face, there is a problem in that part of liquid (for example, fine liquid droplets which are misty) ejected from the plurality of nozzles is attached to the nozzle face. In order to solve the problem, for example, in JP-A-2007-331127, a configuration in which a voltage is applied between a liquid-repellent layer which surrounds each nozzle over the entire periphery thereof and a portion with no liquid-repellent processing in which liquid-repellent processing is not performed has been disclosed.

Incidentally, since a fluorine-based liquid-repellent layer which is located on a negative side on a charging column, for example, is easy to be charged with a negative polarity, there is a case in which ink ejected from a nozzle is charged with a positive polarity. Accordingly, in a state in which a medium such as a printing sheet is charged with a positive polarity, ink resists in the vicinity of a surface of the medium, and is attracted to the liquid-repellent layer, and as a result, the ink can be attached to the nozzle face. In addition, when ink is attached to the nozzle face, it causes an ejecting failure such as clogging of a nozzle, or staining of a medium. In a technology in JP-A-2007-331127, since a liquid-repellent layer is formed so as to be connected to a peripheral edge of a nozzle in the entire periphery of the nozzle when planarly viewed, in practice, it is difficult to effectively prevent attaching of ink to the nozzle face by sufficiently suppressing charging of ink which is caused by the liquid-repellent layer.

SUMMARY

An advantage of some aspects of the invention is to effectively suppress attaching of liquid to a nozzle face using a simple configuration.

According to an aspect of the invention, there is provided a liquid ejecting head which includes a nozzle face on which nozzles ejecting liquid onto a medium are formed; a first region with a liquid repelling property which is connected to a peripheral edge of a nozzle when planarly viewed; and a second region with a liquid repelling property lower than that in the first region, which is connected to a peripheral edge of a nozzle when planarly viewed. In the above configuration, a region which is connected to a peripheral edge of the nozzle, when planarly viewed (that is, region at periphery of nozzle), includes a first region with a liquid repelling property, and a second region with a liquid repelling property which is lower than that in the first region. Since there is a tendency that it is difficult to charge the second region with the low liquid repelling property, compared to the first region, the second region is operated so as to suppress charging of liquid which is ejected from the nozzle. Accordingly, it is also possible to suppress attaching of liquid to the nozzle face due to charging which is caused by the liquid-repellent film, not only to suppress attaching of liquid to the nozzle face using a liquid repelling property in the first region. That is, according to the above configuration, it is possible to effectively suppress attaching of liquid to the nozzle face using a simple configuration.

The liquid ejecting head may include a liquid-repellent film which configures the nozzle face, in which the first region may be a region in which a liquid-repellent film is formed, and the second region may be a region in which the liquid-repellent film is not formed. In the above configuration, a region in which the liquid-repellent film is formed is set to the first region, and a region in which the liquid-repellent film is not formed is set to the second region. Accordingly, there is an advantage that it is possible to easily form the first region and the second region depending on whether to provide the liquid-repellent film or not.

In the liquid ejecting head, the nozzle face may move relatively to a medium, and the second region may be located in a direction intersecting a first direction as a movement direction of the nozzle face which is relative to the medium, when viewed from the nozzle. For example, the second region is located at least one side in a direction which is inclined to the first direction, when viewed from the nozzle. Since air in the vicinity of the nozzle face flows in the first direction in which the nozzle face moves relatively to the medium, there is a tendency that liquid is easily attached, in particular, to a position in the first direction when viewed from the nozzle. According to a configuration in which the second region is located in the direction intersecting the first direction when viewed from the nozzle, based on the above described configuration, it is possible to suppress attaching of liquid to the nozzle face due to charging which is caused by the liquid-repellent film by using the second region, while effectively suppressing attaching of liquid which is caused by an air current in the first direction by using the first region.

In the liquid ejecting head, a plurality of nozzles may be formed on the nozzle face along a second direction which intersects the first direction, the plurality of nozzles may include a first nozzle which is located on one end side in the second direction, and a second nozzle which is located on the other end side which is opposite to the one end side in the second direction, in the first nozzle, the second region may be formed in at least one side of a downstream side in moving of the nozzle face with respect to a medium in the first direction and the one end side in the second direction, and an upstream side in the first direction and the other end side in the second direction, when viewed from the first nozzle, and in the second nozzle, the second region may be formed in at least one side of the downstream side in the first direction and the other end side in the second direction, and an upstream side in the first direction and the one end side in the second direction, when viewed from the second nozzle. In the above described aspect, in a case in which air flows along the nozzle face so as to be further diffused on the upstream side in moving of the nozzle face with respect to the medium, it is possible to suppress attaching of liquid to the nozzle face due to charging which is caused by the liquid-repellent film, using the second region, while effectively suppressing attaching of liquid which is caused by air flow, using the first region.

In the liquid ejecting head, a plurality of nozzles may be formed on the nozzle face, and the second region may be continuous between two nozzles which are adjacent to each other. According to the aspect, since the second region is formed so as to be continuous between two nozzles which are adjacent to each other, there is an advantage that it is possible to suppress charging of liquid (and attaching of liquid to nozzle face caused by the charging) which is caused by the liquid-repellent film, compared to a configuration in which the second region in each nozzle is separated from each other.

According to another aspect of the invention, there is provided a liquid ejecting apparatus which includes the liquid ejecting head according to the above described each aspect. According to the configuration, since attaching of liquid to the nozzle face can be effectively suppressed using a simple configuration, it is possible to prevent a defect such as an ejecting failure such as clogging of a nozzle, or staining of the medium.

The liquid ejecting apparatus may further include a movement mechanism which moves the nozzle face, in which the second region may be located at least one side in a direction intersecting a movement direction of the nozzle face when viewed from a nozzle. Since air in the vicinity of the nozzle face flows in the first direction in which the nozzle face moves, there is a tendency that liquid is easily attached, in particular, to a position in the first direction when viewed from the nozzle. According to a configuration in which the second region is located in a direction intersecting the movement direction of the nozzle face, it is possible to suppress attaching of liquid to the nozzle face due to charging which is caused by the liquid-repellent film, using the second region, while effectively suppressing attaching of liquid which is caused by air flow, using the first region.

The liquid ejecting apparatus may further include a transport mechanism which transports the medium, in which the second region may be located at least one side in a direction intersecting a transport direction of the medium, when viewed from the nozzle. When there is an error in landing position of liquid in the transport direction of the medium, a belt-shaped printing irregularity in a direction orthogonal to the transport direction can occur. According to the configuration in which the second region is located in the direction intersecting the transport direction of the medium, when viewed from the nozzle, it is possible to suppress attaching of liquid to the nozzle face due to charging which is caused by the liquid-repellent film by using the second region, while effectively suppressing a printing irregularity which is caused by an error in landing position in the transport direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
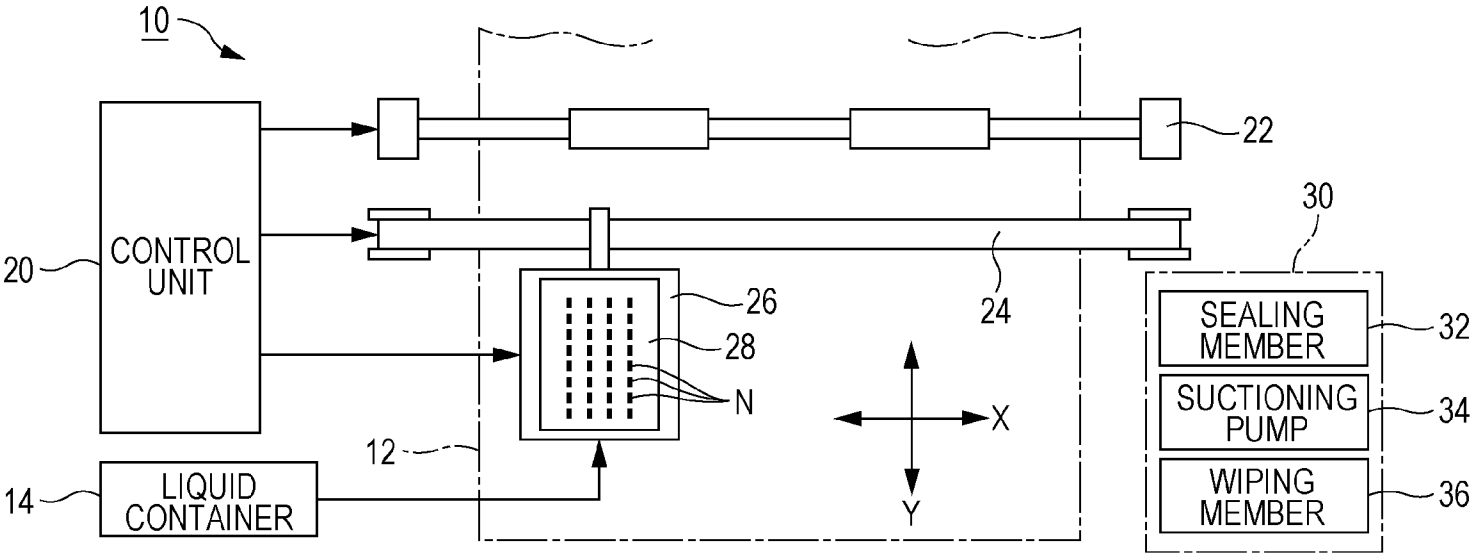
FIG. 1 is a configuration diagram of a liquid ejecting apparatus according to a first embodiment.

FIG. 1 is a configuration diagram of a liquid ejecting apparatus 10 according to a first embodiment of the invention. The liquid ejecting apparatus 10 according to the first embodiment is an ink jet printing apparatus which ejects ink as an example of liquid to a medium 12. A liquid container 14 which stores ink is mounted on the liquid ejecting apparatus 10. According to the first embodiment, a case in which solvent ink with a high weather resistance is ejected onto the medium 12 of a non-absorption type such as polyvinyl chloride is exemplified. The solvent ink is ink which is obtained by dispersing a color material such as a pigment or dye in various solvents such as an oil solvent (for example, diethylene glycol compound such as diethylene glycol diethyl ether), or an aqueous solvent, and conductivity thereof is sufficiently low compared to normal water based ink.

As illustrated in FIG. 1, the liquid ejecting apparatus 10 is provided with a control unit 20, a transport mechanism 22, a movement mechanism 24, a carriage 26, a liquid ejecting head 28, and a maintenance mechanism 30. The control unit 20 includes, for example, a control device such as a central processing unit (CPU), and a recording device such as a semiconductor memory (not illustrated), and integrally controls each element of the liquid ejecting apparatus 10. The transport mechanism 22 includes a transport motor for transporting the medium 12, and a driving circuit which drives the transport motor, for example, and the medium 12 is transported in a Y direction under a control of the control unit 20. The movement mechanism 24 includes a carriage belt to which the carriage 26 is fixed, and a driving motor for rotating the carriage belt, for example, and causes the carriage 26 to reciprocate in an X direction under a control of the control unit 20. The X direction and the Y direction intersect each other (typically, orthogonal to each other).

The liquid ejecting head 28 ejects ink which is supplied from the liquid container 14 to the medium 12 from a plurality of nozzles N under a control of the control unit 20. The liquid ejecting head 28 according to the first embodiment is mounted on the carriage 26. A desired image in formed on the surface of the medium 12 when the liquid ejecting head 28 ejects ink onto the medium 12 in parallel to transporting of the medium 12 using the transport mechanism 22, and repeated reciprocating of the carriage 26 using the movement mechanism 24. In addition, it is also possible to adopt a configuration in which the liquid container 14 is mounted on the carriage 26 along with the liquid ejecting head 28 (on-carriage method).

Figure 2:
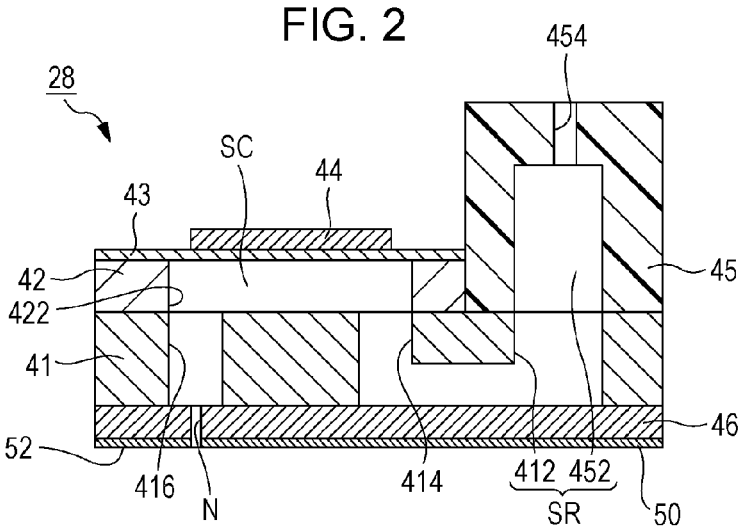
FIG. 2 is a sectional view of a liquid ejecting head.

FIG. 2 is a sectional view of an element which is related to arbitrary one nozzle N in the liquid ejecting head 28. As illustrated in FIG. 2, the liquid ejecting head 28 according to the first embodiment is a layered structure in which a pressure chamber substrate 42, a vibrating plate 43, a piezoelectric element 44, and a support body 45 are disposed on one side of a flow path substrate 41, and a nozzle plate 46 is disposed on the other side. The flow path substrate 41, the pressure chamber substrate 42, and the nozzle plate 46 are formed of a silicon flat plate, for example, and the support body 45 is formed of a resin material which is subjected to injection molding, for example.

The nozzle plate 46 is a flat plate member which faces the medium 12. A plurality of nozzles (through holes) N are formed on the nozzle plate 46. A film with a liquid-repellent property (hereinafter, referred to as "liquid-repellent film") 50 is formed on the surface of the medium 12 side (side opposite to flow path substrate 41) in the nozzle plate 46. The liquid-repellent film 50 can be preferably formed using a fluorine-based liquid-repellent agent such as a silane compound (for example, trifluoropropyl trimethoxysilane) including a fluoroalkyl group, for example. However, a material of the liquid-repellent film 50 is not limited to the above example. Due to a liquid repelling operation of the liquid-repellent film 50, liquid droplets of ink are rapidly separated from the nozzle N, and as a result, tailing of ink is suppressed, and it is possible to obtain expected ejecting characteristics (for example, ejecting time or flying speed of ink). In addition, it is also possible to form the liquid-repellent film 50 using a film of silicon oxide, or the like, which covers the surface of the nozzle plate 46 as a base. A surface (hereinafter, referred to as "nozzle face") 52 of the liquid-repellent film 50 faces the medium 12.

An opening portion 412, a branching flow path (throttling flow path) 414, and a communication flow path 416 are formed in the flow path substrate 41. The branching flow path 414, and the communication flow path 416 are through holes which are formed in each nozzle N, and the opening portions 412 are openings which are continuous over the plurality of nozzles N. A space which causes an accommodating portion (recessed portion) 452 which is formed in the support body 45, and the opening portion 412 of the flow path substrate 41 to communicate with each other functions as a common liquid chamber (reservoir) SR which stores ink supplied from the liquid container 14 through an introducing flow path 454 of the support body 45.

The opening portion 422 is formed in each nozzle N on the pressure chamber substrate 42. The vibrating plate 43 is a flat plate member which is provided on the surface of the pressure chamber substrate 42 on the side opposite to the flow path substrate 41, and which can be elastically deformed. A space which is interposed between the vibrating plate 43 and the flow path substrate 41 in the inside of each opening portion 422 of the pressure chamber substrate 42 functions as a pressure chamber (cavity) SC which is filled with ink supplied through the branching flow path 414 from the common liquid chamber SR. Each pressure chamber SC communicates with the nozzle N through the communication flow path 416 of the flow path substrate 41.

The piezoelectric element 44 is provided in each nozzle N on the surface of the vibrating plate 43 on a side opposite to the pressure chamber substrate 42. Each piezoelectric element 44 is a driving element which is obtained by interposing a piezoelectric layer between electrodes which face each other. When the vibrating plate 43 vibrates due to deforming of the piezoelectric element 44, due to supplying of a driving signal, a pressure in the pressure chamber SC fluctuates, and ink in the pressure chamber SC is ejected from the nozzle N. In addition, it is also possible to use a heating-type liquid ejecting head 28 which uses a heating element which changes a pressure in the pressure chamber SC by generating bubbles in the pressure chamber SC using heating.

The maintenance mechanism 30 in FIG. 1 is a mechanism which executes a process for maintaining (hereinafter, referred to as "maintenance operation") the liquid ejecting head 28 under a control of the control unit 20. Specifically, the maintenance mechanism 30 includes a sealing member 32 which is in close contact with the nozzle face 52 of the liquid ejecting head 28, a suctioning pump 34 which suctions ink in the liquid ejecting head 28 in a state in which the sealing member 32 seals the nozzle face 52, and a wiping member 36 which wipes the nozzle face 52. According to the first embodiment, a suctioning process using the sealing member 32 and the suctioning pump 34, and a wiping process using the wiping member 36 are exemplified as the maintenance operation.

Figure 3:
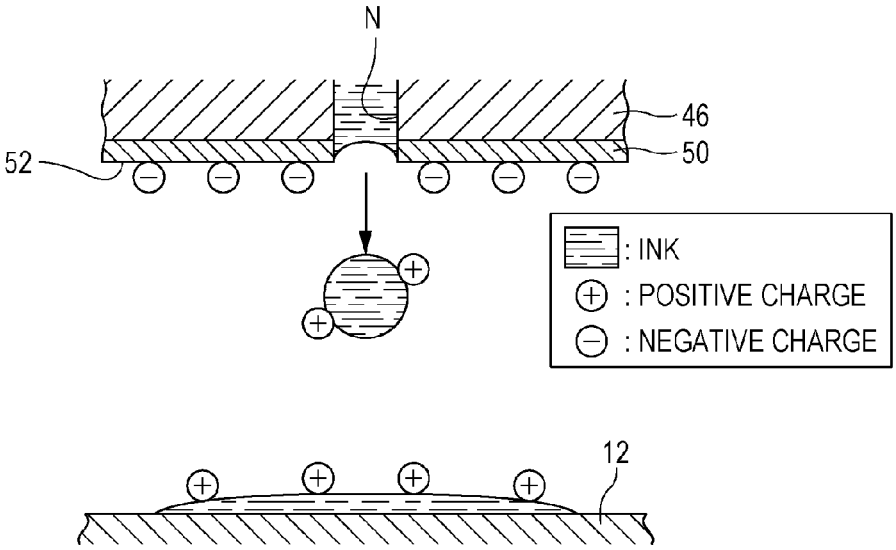
FIG. 3 is a diagram for explaining charging of liquid which is caused by a liquid-repellent film.

As illustrated in FIG. 3, the liquid-repellent film 50 of the liquid ejecting head 28 can be charged. For example, since the fluorine-based liquid repellent agent is located at a position closest to a negative side in a charging column, there is a tendency that the liquid-repellent film 50 is charged with a negative polarity. Specifically, the liquid-repellent film 50 is charged with a negative polarity due to a contact with the sealing member 32, or a contact with the wiping member 36 in the suctioning process in the maintenance operation, and is discharged over time, after the maintenance operation is executed. As described above, ink which is ejected from the nozzle N in a state in which the liquid-repellent film 50 is charged with a negative polarity tends to be charged with a positive polarity which is opposite to that of the liquid-repellent film 50. Accordingly, the surface of the medium 12 onto which ink ejected from the liquid ejecting head 28 lands is charged with the positive polarity which is the same as that of ink. In addition, in a case in which a medium 12 such as a printing sheet, cloth, or tarpaulin, for example, is used, there also is a possibility that the medium 12 is charged with the positive polarity by being in contact with another element (for example, transport roller or platen) at a time of transporting, using the transport mechanism 22. Similarly, when ink charged with the positive polarity is ejected from the nozzle N of liquid ejecting head 28, in a state in which the medium 12 is charged with the positive polarity as described above, ink resists in the vicinity of the surface of the medium 12, a moving direction is reversed to the nozzle face 52 side, and ink is attracted to the liquid-repellent film 50 with a negative polarity, and as a result, there is a possibility that ink is attached to the nozzle face 52.

As is understood from the above example, the liquid-repellent film 50 is operated so that expected ejecting characteristics are obtained by promoting a separation of ink (so-called "fragment") from the nozzle face 52 at a time of ejecting (liquid repelling operation), and on the other hand, the liquid-repellent film is operated so as to cause ink to be attached to the nozzle face 52 by charging ink with the positive polarity. Since a charged state of the solvent ink with low conductivity is maintained for a long time compared to water based ink, in a configuration in which the solvent ink is used, as in the first embodiment, attaching of ink to the nozzle face 52 due to charging caused by the liquid-repellent film 50 becomes particularly apparent. According to the first embodiment, in the liquid-repellent film 50, a planar shape is selected so that the operation of charging ink using the liquid-repellent film 50 (hereinafter, referred to as "charging operation") is weakened, in consideration of the above described situation.

Figure 4:
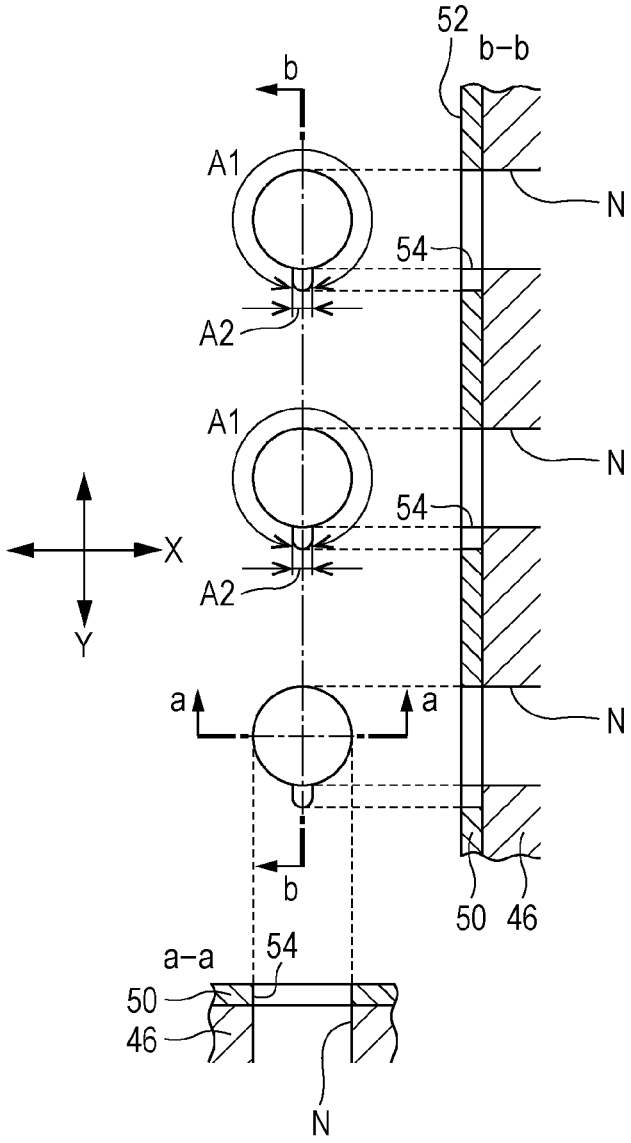
FIG. 4 is a plan view and a sectional view in which a nozzle face of the liquid ejecting head is enlarged.

FIG. 4 is a plan view and a sectional view in which the nozzle face 52 of the liquid ejecting head 28 is enlarged. In FIG. 4, a sectional view which is cut along line a-a, and a sectional view which is cut along line b-b in the plan view in FIG. 4 are illustrated together. As illustrated in FIG. 4, an opening portion 54 corresponding to each nozzle N of the nozzle plate 46 is formed in the liquid-repellent film 50. The opening portion 54 is a region in which the liquid-repellent film 50 is not present in a range which is overlapped with the nozzle N, when viewed planarly (that is, when viewed in direction perpendicular to nozzle face 52).

As illustrated in FIG. 4, the first region A1 and the second region A2 are defined at the periphery of the nozzle N, when viewed planarly. FIG. 4 illustrates a configuration in which the second region A2 is located on one side (lower side in FIG. 4) in the Y direction when viewed from each nozzle N in a planar view.

The first region A1 is a region with a liquid-repellent property in which the liquid-repellent film 50 is formed, and is connected to a peripheral edge of the nozzle N when viewed planarly. That is, the first region A1 is continuous in a region in the inside of the nozzle N, when viewed planarly. On the other hand, the second region A2 is a region in which the liquid-repellent film 50 is not formed, and similarly to the first region A1, the second region is connected to the peripheral edge of the nozzle N, when viewed planarly. Specifically, the second region A2 is a region in which the surface of the nozzle plate 46 (or, base film which covers nozzle plate 46) is exposed, and also can be expressed as a notched region which is formed in the liquid-repellent film 50 so as to be connected to the opening portion 54, when viewed planarly. Since the liquid-repellent film 50 is not formed in the second region A2, a liquid-repellent property in the second region A2 is lower than that in the first region A1. In other words, the second region A2 is a region with a small contact angle with respect to ink, compared to the first region A1.

Since the liquid-repellent film 50 is present in the first region A1, as described above, there is a charging operation which charges ink with a positive polarity at a time of ejecting, in addition to the original liquid repelling operation which promotes a separation of ink from the nozzle face 52. On the other hand, since the liquid-repellent film 50 is not present in the second region A2, the charging operation is weaker than that in the first region A1. Specifically, since silicon as a material of the nozzle plate 46 which is exposed to the second region A2 has a polarity between a positive polarity and a negative polarity in the charging column, and is not easily charged compared to the fluorine-based liquid-repellent agent as a material of the liquid-repellent film 50, the liquid repelling operation in the second region A2 is weaker than that in the first region A1.

As is understood from the above description, according to the first embodiment, charging of ink ejected from the nozzle N is suppressed compared to a configuration in which the liquid-repellent film 50 is formed at the entire periphery of the nozzle N (that is, configuration in which second region A2 is not formed), when viewed planarly, since the second region A2 is connected to the peripheral edge of the nozzle N, in addition to the first region A1. Accordingly, it is possible to effectively suppress attaching of ink to the nozzle face 52 which is caused by charging, using a simple configuration. According to the first embodiment, particularly, the region in which the liquid-repellent film 50 is formed is set to the first region A1, and the region in which the liquid-repellent film 50 is not formed is set to the second region A2. Accordingly, there is an advantage that it is possible to easily define the first region A1 and the second region A2 depending on whether to provide the liquid-repellent film 50 or not.

Second Embodiment

A second embodiment of the invention will be described. In each form which will be exemplified below, elements with the same operation or function as that in the first embodiment will be given the same reference numerals which are used in descriptions of the first embodiment, and detailed descriptions thereof will be appropriately omitted.

Figure 5:
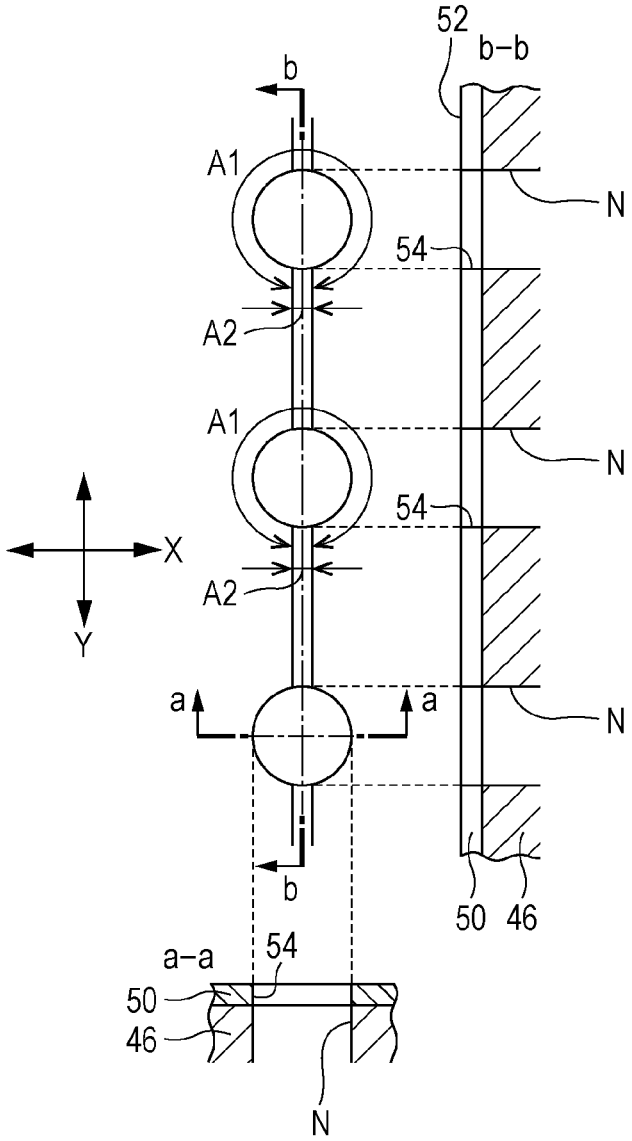
FIG. 5 is a plan view and a sectional view of a nozzle face of a liquid ejecting head according to a second embodiment.

FIG. 5 is a plan view and a sectional view in which a nozzle face 52 in the second embodiment is enlarged. As illustrated in FIG. 5, a plurality of nozzles N are formed along the Y direction on the nozzle face 52 in the second embodiment. A second region A2 is formed in a linear shape which extends in the Y direction so as to be continuous over two nozzles N which are adjacent to each other in the Y direction.

The same effect as that in the first embodiment is obtained also in the second embodiment. In addition, since the second region A2 which is continuous over two nozzles N which are adjacent to each other is formed in the second embodiment, the effect of suppressing charging of ink which is caused by the liquid-repellent film 50 becomes specially apparent.

Third Embodiment

Figure 6:
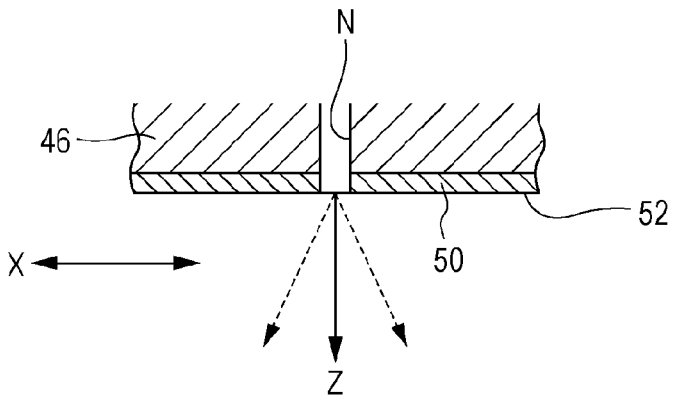
FIG. 6 is a diagram for explaining a relationship between an air current and ejecting of ink according to a third embodiment.

FIG. 6 is a diagram for explaining a relationship between air flow (hereinafter, referred to as "air current") along the nozzle face 52 of the liquid ejecting head 28 and ejecting of ink. In a configuration in which a carriage 26 on which the liquid ejecting head 28 is mounted reciprocate in the X direction, an air current in the X direction is generated in the vicinity of the nozzle face 52. Accordingly, ink ejected from the nozzle N moves in a direction which is inclined to the X direction with respect to a Z direction (that is, vertical direction) which is perpendicular to the nozzle face 52, as denoted by a dashed line in FIG. 6, due to an influence of the air current which goes along the X direction, and as a result, there is a possibility that an error occurs in a landing position on the surface of the medium 12. In a viewpoint of reducing the error in the landing position by setting a movement direction of ink after being ejected to be close to the Z direction, it is desirable to rapidly separate ink from the nozzle N, by giving a priority to the liquid repelling operation of the liquid-repellent film 50 in the X direction in which air current moves.

Figure 7:
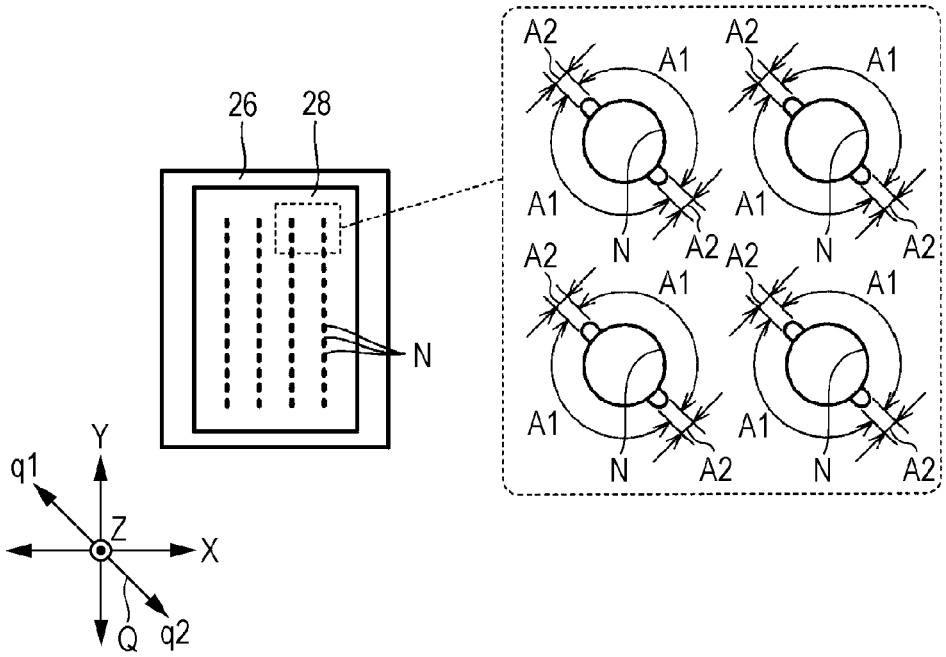
FIG. 7 is a plan view of a nozzle face of a liquid ejecting head according to the third embodiment.

In consideration of the above described situation, in the third embodiment, as illustrated in FIG. 7, the first region A1 with the liquid-repellent property is formed at a position in the X direction (that is, direction of air current) when viewed from the nozzle N in a planar view, and the second region A2 is formed in a Q direction which intersects the X direction when viewed from the nozzle N in a planar view. In FIG. 7, a case in which a direction inclined to the X direction with a predetermined angle (that is, direction intersecting without forming right angle) is set to the Q direction is exemplified. Specifically, when one side in the Q direction is set to a q1 side, and the other side is denoted by a q2 side, the second region A2 is formed on both sides of the q1 side and the q2 side in the Q direction when viewed from the nozzle N in a planar view.

Incidentally, in a configuration in which the carriage 26 reciprocates in the X direction, the medium 12 is transported in the Y direction which is orthogonal to the X direction. In the above described configuration, when an error occurs in the landing position of ink in the Y direction, a belt-shaped printing irregularity (so-called banding) which extends along the width direction (X direction) of the medium 12 becomes apparent. Accordingly, it is desirable to suppress the error occurs in the landing position, by giving a priority to the liquid repelling operation in the Y direction in which the medium 12 is transported. In consideration of the above described situation, in the configuration in FIG. 7, the first region A1 with the liquid-repellent property is formed at a position in the Y direction (that is, transport direction of medium 12) when viewed from the nozzle N in a planar view, and the second region A2 is formed in the Q direction (q1 side and q2 side) which intersects the Y direction when viewed from the nozzle N in a planar view. That is, the Q direction in which the second region A2 is formed is a direction intersecting (specifically, inclining to) both of the directions of the X direction in which the carriage 26 moves and the Y direction in which the medium 12 is transported.

Also in the third embodiment, the same effect as that in the first embodiment is obtained. In addition, in the third embodiment, the first region A1 with the liquid repelling property is formed in the X direction, and the second region A2 is formed in the Q direction which intersects the X direction, when viewed from the nozzle N in a planar view. Accordingly, there is an advantage that it is possible to suppress charging of ink which is caused by the liquid-repellent film 50 (and, attaching of ink to nozzle face caused by charging), while reducing an error in landing position which is caused by the air current in the X direction in the vicinity of the nozzle face 52. In addition, according to the third embodiment, the first region A1 with the liquid repelling property is formed in the Y direction, and the second region A2 is formed in the Q direction which intersects the Y direction, when viewed from the nozzle N in a planar view. Accordingly, there is an advantage that it is possible to suppress charging of ink which is caused by the liquid-repellent film 50, while reducing a belt-shaped printing irregularity which goes along the X direction.

Fourth Embodiment

Figure 8:
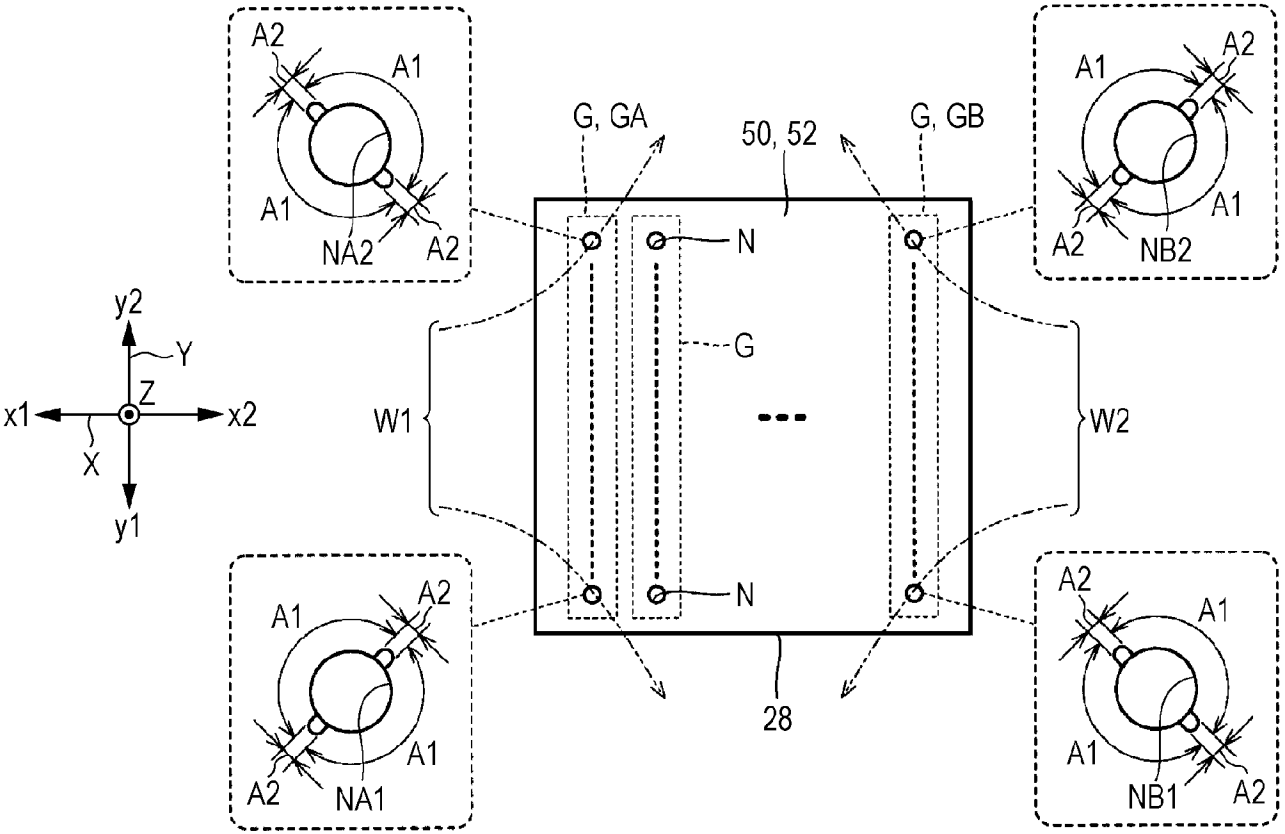
FIG. 8 is a plan view of a nozzle face of a liquid ejecting head according to a fourth embodiment.

FIG. 8 is a diagram for explaining a relationship between an air current which goes along the nozzle face 52 of the liquid ejecting head 28 and ejecting of ink. In FIG. 8, one side in the X direction is set to the x1 side, and the other end side is set to the x2 side, and one side in the Y direction is set to the y1 side, and the other side is set to the y2 side. In addition, in FIG. 8, a case in which an arrangement of the plurality of nozzles N (hereinafter, referred to as "nozzle column") G which goes along the Y direction is provided in the X direction over the plurality of nozzle columns will be assumed.

According to the third embodiment, a linear current which goes along the X direction is conveniently assumed; however, in practice, an air current which goes along the direction inclined to the X direction is also assumed. Specifically, as illustrated in FIG. 8, in a process in which the nozzle face 52 moves to the x1 side in the X direction, for example, an air current W1 which is further diffused on the x2 side in the X direction, when viewed planarly, is assumed, and in a process in which the nozzle face 52 moves to the x2 side in the X direction, an air current W2 which is further diffused on the x1 side in the X direction, when viewed planarly, is assumed. According to the fourth embodiment, the first region A1 is formed in a direction which goes along the air currents (W1, W2) when viewed from the nozzle N, and the second region A2 is formed in a direction which intersects the direction.

First, a nozzle column GA in a plurality of nozzle columns G of the liquid ejecting head 28, which is located on the x1 side in the X direction will be focused. In a process in which the nozzle face 52 moves to the x1 side in the X direction, the nozzle column GA is particularly influenced by the air current W1 in FIG. 8. Therefore, positions of the first region A1 and the second region A2 are selected according to a direction of the air current W1, with respect to each nozzle N of the nozzle column GA.

Specifically, in a nozzle NA1 (first nozzle) in the nozzle column GA, which is located on a y1 side in the Y direction, the second region A2 is formed on an x1 side in the X direction (downstream side in moving of nozzle face 52 with respect to medium 12) and a y1 side in the Y direction, and an x2 side in the X direction (upstream side in moving of nozzle face 52 with respect to medium 12), and a y2 side in the Y direction, when viewed from the nozzle NA1. The first region A1 is formed in each position (x1 side in X direction and y2 side in Y direction, and x2 side in X direction and y1 side in Y direction) in a direction which goes along an air current W1 when viewed from the nozzle NA1. On the other hand, in a nozzle NA2 (second nozzle) in the nozzle column GA, which is located on the y2 side in the Y direction, the second region A2 is formed on the x1 side in the X direction and the y2 side in the Y direction, and the x2 side in the X direction and the y1 side in the Y direction, and the first region A1 is formed in each position in a direction which goes along the air current W1, when viewed from the nozzle NA2. As is understood from the above descriptions, in both of the nozzle NA1 and the nozzle NA2, the second region A2 is formed in a direction intersecting both of the directions of the X direction in which the nozzle face 52 moves and the Y direction in which the medium 12 is transported, similarly to that in the third embodiment. Positions and shapes of the first region A1 and the second region A2 are in a relationship of a line symmetry related to an axial line in the X direction between the nozzle NA1 and the nozzle NA2.

Subsequently, a nozzle column GB in the plurality of nozzle columns G of the liquid ejecting head 28, which is located on the x2 side in the X direction will be focused. In a process in which the nozzle face 52 moves to the x2 side in the X direction, the nozzle column GB is particularly influenced by the air current W2 in FIG. 8. Therefore, positions of the first region A1 and the second region A2 are selected according to a direction of the air current W2, with respect to each nozzle N of the nozzle column GB.

Specifically, in a nozzle NB1 in the nozzle column GB, which is located on the y1 side in the Y direction, the second region A2 is formed on the x2 side in the X direction (downstream side in moving of nozzle face 52 with respect to medium 12) and the y1 side in the Y direction), and the x1 side in the X direction (upstream side in moving of nozzle face 52 with respect to medium 12) and the y2 side in the Y direction, when viewed from the nozzle NB1. On the other hand, in a nozzle NB2 in the nozzle column GB, which is located on the y2 side in the Y direction, the second region A2 is formed on the x2 side in the X direction and the y2 side in the Y direction, and the x1 side in the X direction and the y1 side in the Y direction, when viewed from the nozzle NB2. The first region A1 is formed in each position in a direction which goes along an air current W2, in each of the nozzle NB1 and the nozzle NB2. That is, the second region A2 is formed in a direction intersecting both of the directions of the X direction in which the nozzle face 52 moves and the Y direction in which the medium 12 is transported, in both of the nozzle NB1 and the nozzle NB2. Positions and shapes of the first region A1 and the second region A2 are in a relationship of a line symmetry related to an axial line in the Y direction between the nozzle column GA and the nozzle column GB.

The same effect as that in the first embodiment also can be obtained in the fourth embodiment. In addition, according to the fourth embodiment, even in a case in which the air current (W1, W2) in the vicinity of the nozzle face 52 is inclined to the X direction and the Y direction, it is possible to suppress charging of ink which is caused by the liquid-repellent film 50, while reducing an error in landing position which is caused by the air current.

Fifth Embodiment

In the first to fourth embodiments, the serial-type liquid ejecting apparatus 10 in which the carriage 26 on which the liquid ejecting head 28 is mounted is reciprocated has been exemplified. In a fifth embodiment, as illustrated in FIG. 9, a line-type liquid ejecting apparatus 10 in which a liquid ejecting head 29 in which a plurality of nozzles N are distributed over the entire region of the medium 12 in the width direction is used is exemplified.

Figure 9:
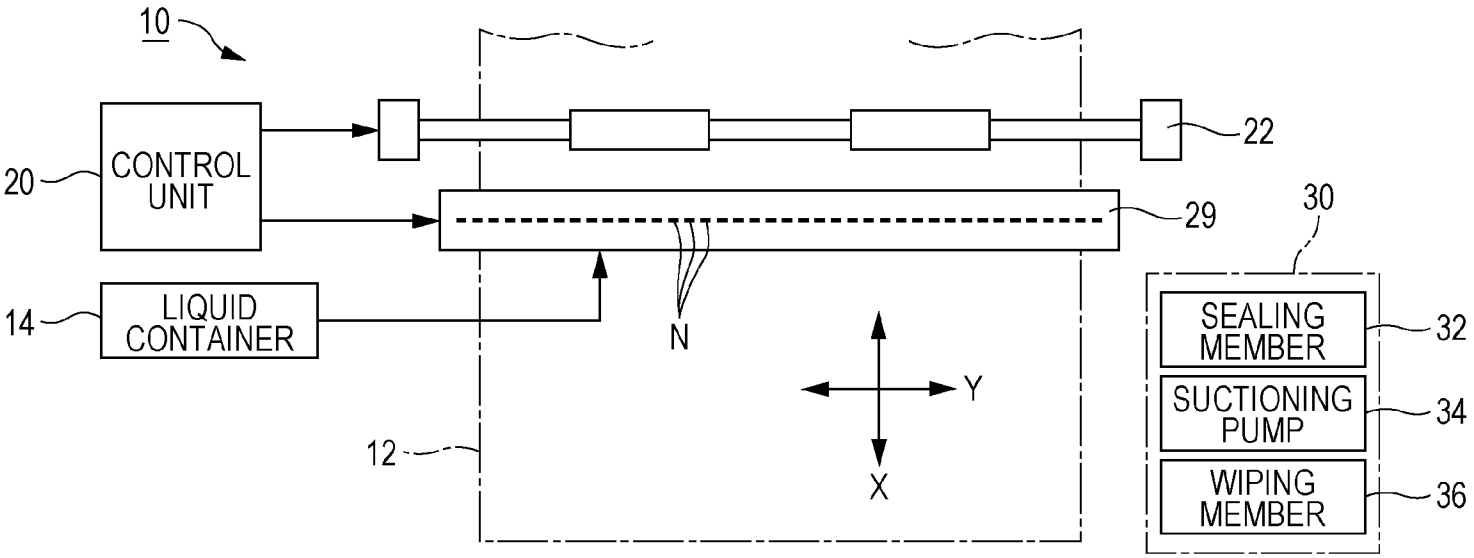
FIG. 9 is a configuration diagram of a liquid ejecting apparatus according to a fifth embodiment.

As illustrated in FIG. 9, a transport mechanism 22 according to the fifth embodiment transports the medium 12 in the X direction. The liquid ejecting head 29 is a line head in which a plurality of nozzles N are provided on the nozzle face 52 along the Y direction (that is, width direction of medium 12) which intersects the X direction. As is understood from the above descriptions, the X direction in the first to fifth embodiments is included as a movement direction of the nozzle face 52 (first direction) which is relative to the medium 12.

Figure 10:
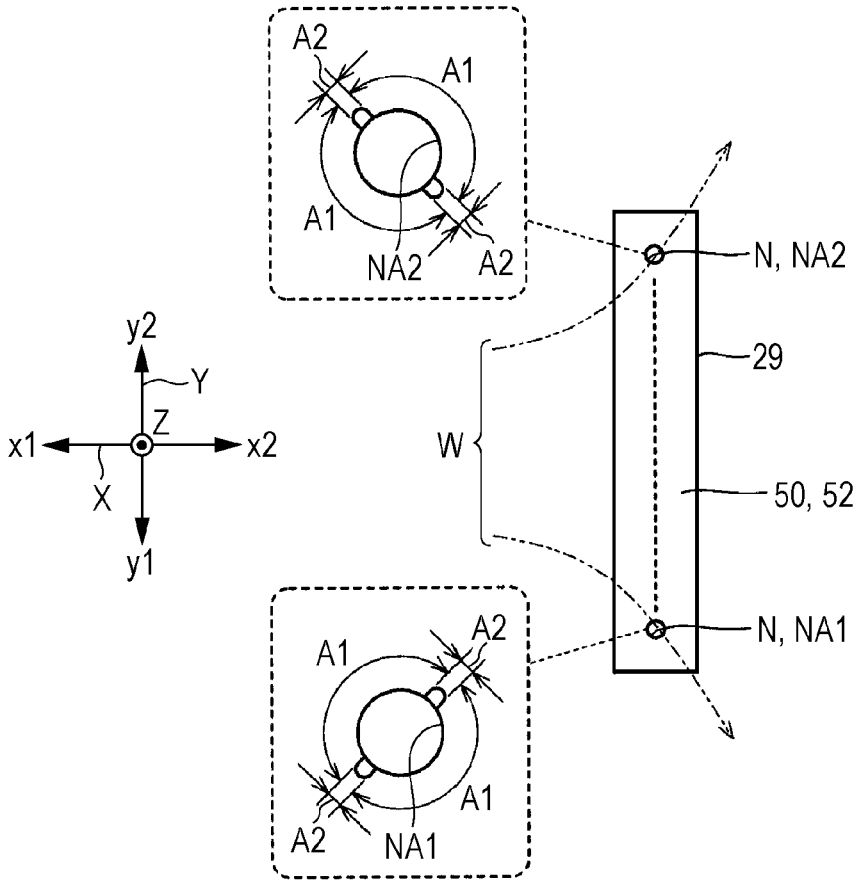
FIG. 10 is a plan view of a nozzle face of a liquid ejecting head according to the fifth embodiment.

FIG. 10 is a plan view of the nozzle face 52 of the liquid ejecting head 29. As illustrated in FIG. 10, when the medium 12 moves to the x2 side in the X direction (that is, when nozzle face 52 moves to x1 side relatively to medium 12), an air current W which moves to the x2 side so as to be further diffused on the x2 side in the X direction is generated in the vicinity of the nozzle face 52, similarly to the air current W1 in FIG. 8. According to the fifth embodiment, positions of the first region A1 and the second region A2 with respect to each nozzle N are selected according to a direction of the air current W, similarly to that in the fourth embodiment.

Specifically, in the nozzle NA1 (first nozzle) which is located on the y1 side in the Y direction, the second region A2 is formed on the x1 side in the X direction and the y1 side in the Y direction, and the x2 side in the X direction and the y2 side in the Y direction, when viewed from the nozzle NA1. The first region A1 is formed in each position in a direction which goes along the air current W, when viewed from the nozzle NA1. On the other hand, in the nozzle NA2 which is located on the y2 side in the Y direction, the second region A2 is formed on the x1 side in the X direction and the y2 side in the Y direction, and the x2 side in the X direction and the y1 side in the Y direction, when viewed from the nozzle NA2, and the first region A1 is formed in each position in a direction which goes along the air current W1. That is, a relationship between each nozzle N and the first region A1 and the second region A2 in the fifth embodiment is the same as the relationship between each nozzle N of the nozzle column GA and the first region A1 and the second region A2 in the fourth embodiment. Accordingly, the same effect as that in the first embodiment and the fourth embodiment is obtained also in the fifth embodiment.

Modification Example

Each embodiment which is exemplified above can be variously modified. A specific modification will be exemplified below. Two or more forms which are arbitrarily selected from the following examples can be appropriately combined in a range in which the forms do not conflict with each other.

(1) In each embodiment which is described above, the region in which the liquid-repellent film 50 is formed is set to the first region A1, and the region in which the liquid-repellent film 50 is not formed is set to the second region A2; however, specific configurations of the first region A1 and the second region A2 are not limited to the above described examples. For example, a configuration in which a region in which a film with a low liquid repelling property compared to the liquid-repellent film 50 is formed on the surface of the liquid-repellent film 50 is set to the second region A2, or a configuration in which a region in which a film thickness of the liquid-repellent film 50 is smaller (accordingly, liquid repelling property is low) than that in the first region A1 is set to the second region A2 is also can be adopted. As is understood from the above descriptions, the second region A2 is comprehensively expressed as a region with low liquid repelling property compared to the first region A1, and a specific configuration for realizing a difference in liquid repelling property is not particularly limited.

(2) The number of second regions A2 with respect to one nozzle N is not limited to the example in each embodiment. For example, a configuration in which only one second region A2 is formed with respect to one nozzle N, or a configuration in which three or more second regions A2 are formed with respect to one nozzle N also can be adopted in the fourth embodiment. In addition, each embodiment which is described above can be appropriately combined. For example, it is also possible to form the second region A2 so as to be continuous between two nozzles N which are adjacent to each other, under a control of the line-type liquid ejecting apparatus 10 which is exemplified in the fifth embodiment.

(3) In a viewpoint of suppressing charging of ink which is caused by the liquid-repellent film 50, a configuration in which the liquid-repellent film 50 is grounded is also preferable. According to the above configuration, since a charge generated in the liquid-repellent film 50 is discharged, and charging is suppressed, there is an advantage that it is possible to suppress charging of ink (and attaching of ink to nozzle face 52) which is caused by the liquid-repellent film 50.

(4) The liquid ejecting apparatus 10 exemplified in each embodiment which is described above can be adopted in various devices such as a fax machine or a copy machine, in addition to an exclusive device for printing. Naturally, a use of the liquid ejecting apparatus in the invention is not limited to printing. For example, a liquid ejecting apparatus which ejects a coloring solution is used as a manufacturing apparatus which forms a color filter of a liquid crystal display device. In addition, a liquid ejecting apparatus which ejects a solution of a conductive material is used as a manufacturing apparatus which forms wiring or an electrode of a wiring board.

The entire disclosure of Japanese Patent Application No. 2015-171736, filed Sep. 1, 2015 is expressly incorporated by reference herein.

What is claimed is:

1. A liquid ejecting head comprising:

a nozzle face on which nozzles ejecting liquid onto a medium are formed, the nozzle face including a nozzle face surface, the nozzle face surface including a first region and a second region and the nozzles including a nozzle;

the first region having a liquid repelling property, wherein the first region extends to a peripheral edge of the nozzle when planarly viewed; and the second region having a liquid repelling property lower than that the liquid repelling property in the first region, wherein the second region extends to the peripheral edge of the nozzle when planarly viewed.

2. The liquid ejecting head according to claim 1, further comprising:

a liquid-repellent film which configures the nozzle face, wherein the first region is a region in which the liquid-repellent film is formed, and wherein the second region is a region in which the liquid-repellent film is not formed.

3. The liquid ejecting head according to claim 1, wherein movement of the liquid ejecting head moves the nozzle face relatively to the medium, and wherein the second region is located in a direction intersecting a first direction as a movement direction of the nozzle face which is relative to the medium, when viewed from the nozzle.

4. The liquid ejecting head according to claim 3, wherein the second region is located at at least one side in a direction which is inclined to the first direction, when viewed from the nozzle.

5. The liquid ejecting head according to claim 4, wherein the nozzles are formed on the nozzle face along a second direction which intersects the first direction, wherein the nozzles include a first nozzle which is located on one end side in the second direction, and a second nozzle which is located on the other end side which is opposite to the one end side in the second direction, wherein, in the first nozzle, the second region is formed in at least one side of a downstream side in moving of the nozzle face with respect to a medium in the first direction and the one end side in the second direction, and an upstream side in the first direction and the other end side in the second direction, when viewed from the first nozzle, and wherein, in the second nozzle, the second region is formed in at least one side of the downstream side in the first direction and the other end side in the second direction, and the upstream side in the first direction and the one end side in the second direction, when viewed from the second nozzle.

6. The liquid ejecting head according to claim 1, wherein the second region is continuous between two nozzles which are adjacent to each other.

7. A liquid ejecting apparatus comprising:

the liquid ejecting head according to claim 1.

8. The liquid ejecting apparatus according to claim 7, further comprising:

a movement mechanism which moves the nozzle face, wherein the second region is located at least one side in a direction intersecting a movement direction of the nozzle face, when viewed from the nozzle.

9. The liquid ejecting apparatus according to claim 7, further comprising:

a transport mechanism which transports the medium, wherein the second region is located at least one side in a direction intersecting a transport direction of the medium, when viewed from the nozzle.

10. A liquid ejecting head comprising:

a nozzle plate having a plurality of nozzles formed therein, the nozzle plate including a nozzle plate surface;

a liquid repellant film formed on the nozzle plate surface, the liquid repellant film including nozzle openings formed therein that correspond to the plurality of nozzles;

wherein an area surrounding a peripheral edge of at least one nozzle included in the plurality of nozzles includes a first region having a first liquid repelling property and a second region having a second liquid repelling property wherein the first region includes an edge that extends to and is directly adjacent a first portion of the peripheral edge and the second region includes an edge that extends to and is directly adjacent a second portion of the peripheral edge.

11. The liquid ejecting head of claim 10, wherein the liquid repellant film is formed in the first region and wherein the liquid repellant film is not present in the second region.

12. A liquid ejecting head comprising:

a nozzle face on which nozzles that are configured to eject liquid onto a medium are formed, the nozzle face including a nozzle face surface, the nozzle face surface including a first region and a second region;

the first region having a liquid repelling property, wherein the first region extends to a peripheral edge of at least one of the nozzles when viewed in a direction perpendicular to the nozzle face; and the second region having a liquid repelling property lower than the liquid repelling property in the first region, wherein the second region extends to the peripheral edge of the one nozzle when viewed in the direction perpendicular to the nozzle.

13. The liquid ejecting head according to claim 12, further comprising:

a liquid-repellent film which configures the nozzle face, wherein the first region is a region in which the liquid-repellent film is formed, and wherein the second region is a region in which the liquid-repellent film is not formed.

14. The liquid ejecting head according to claim 12, wherein the nozzle face moves relatively to the medium, and wherein the second region is located in a direction intersecting a first direction as a movement direction of the nozzle face which is relative to the medium, when viewed from the nozzle.

15. The liquid ejecting head according to claim 14, wherein the second region is located at least one side in a direction which is inclined to the first direction, when viewed from the nozzle.

16. The liquid ejecting head according to claim 12, wherein a plurality of nozzles are formed on the nozzle face, and wherein the second region is continuous between two nozzles which are adjacent to each other.

17. A liquid ejecting apparatus comprising:

the liquid ejecting head according to claim 1.

* * * * *